US009791156B2

(12) United States Patent
Cadima

(10) Patent No.: US 9,791,156 B2
(45) Date of Patent: Oct. 17, 2017

(54) ELONGATED BURNER ASSEMBLY

(71) Applicant: General Electric Company, Schenectady, NY (US)

(72) Inventor: Paul Bryan Cadima, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 595 days.

(21) Appl. No.: 14/446,655

(22) Filed: Jul. 30, 2014

(65) Prior Publication Data

US 2016/0033139 A1 Feb. 4, 2016

(51) Int. Cl.
*F24C 3/08* (2006.01)
*F23D 14/06* (2006.01)

(52) U.S. Cl.
CPC ..... *F24C 3/085* (2013.01); *F23D 14/06* (2013.01); *F23D 2203/101* (2013.01)

(58) Field of Classification Search
None
See application file for complete search history.

(56) References Cited

U.S. PATENT DOCUMENTS 3,386,432 A * 6/1968 Hauson ..... A47J 37/0682 126/41 R
4,170,981 A * 10/1979 Hakata ..... F23D 11/00 126/38
5,649,822 A * 7/1997 Gertler ..... F23D 14/06 126/39 E
6,632,132 B1 * 10/2003 Kikuchi ..... F24C 15/2028 126/299 D
8,616,193 B2 12/2013 Padgett
9,541,294 B2 * 1/2017 Angulo ..... F24C 3/08
2004/0195399 A1 * 10/2004 Molla ..... F24C 3/085 239/594
2007/0224562 A1 * 9/2007 Hiromitsu ..... F23C 7/002 431/182
2010/0263658 A1 * 10/2010 Ryu ..... F24C 3/085 126/39 E
2012/0090595 A1 * 4/2012 Shaffer ..... F23D 14/06 126/39 E
2013/0092149 A1 * 4/2013 Lona Santoyo ..... F24C 3/085 126/39 E

* cited by examiner

*Primary Examiner* — Avinash Savani
(74) *Attorney, Agent, or Firm* — Dority & Manning, P.A.

(57) ABSTRACT

An elongated burner assembly includes a first sidewall that defines a first plurality of ports and a second sidewall that defines a second plurality of ports. Ports of the first plurality of ports are angled towards a first end portion of the elongated burner, and ports of the second plurality of ports are angled towards a second end portion of the elongated burner. A related range appliance is also provided.

17 Claims, 3 Drawing Sheets

ELONGATED BURNER ASSEMBLY

FIELD OF THE INVENTION

The present subject matter relates generally to burner assemblies, such as burner assemblies for range appliances.

BACKGROUND OF THE INVENTION

Range appliances generally include a cooktop portion and an oven portion. The cooktop portion of certain range appliances includes a griddle burner for heating large cookware, such as griddles and fish poachers. Griddle burners provide flame ports along a length of the griddle burner in order to heat large cookware on the cooktop portion.

Evenly heating large cookware with griddle burners can be difficult due to uneven temperature distributions along a length of the griddle burners. Because the griddle burners are not as long as the griddle, the griddle tends to be hotter at its center and cooler at its ends. If the griddle burner were longer in an effort to offset this effect, the manufacturing cost of the griddle burner would increase accordingly. Furthermore, a minimum firing rate that the griddle burner could support would increase due to the increased perimeter of the griddle burner, thereby increasing a heat output of the griddle burner at its minimum setting. Finally, the extra length could cause the griddle burner to be longer than typical fish poachers, thereby reducing the versatility of the griddle burner as it would no longer be suitable for such cookware.

Accordingly, a burner assembly with features for assisting with heating a griddle and cookware smaller than a griddle would be useful. In particular, a burner assembly with features for assisting with uniformly heating a griddle and uniformly heating cookware smaller than a griddle would be useful.

BRIEF DESCRIPTION OF THE INVENTION

The present subject matter provides an elongated burner assembly. The elongated burner assembly includes a first sidewall that defines a first plurality of ports and a second sidewall that defines a second plurality of ports. Ports of the first plurality of ports are angled towards a first end portion of the elongated burner, and ports of the second plurality of ports are angled towards a second end portion of the elongated burner. A related range appliance is also provided. Additional aspects and advantages of the invention will be set forth in part in the following description, or may be apparent from the description, or may be learned through practice of the invention.

In a first exemplary embodiment, an elongated burner assembly is provided. The elongated burner defines a major axis and a minor axis. The elongated burner includes a base plate extending between a first end portion and a second end portion along the major axis. A first sidewall is mounted to the base plate and positioned adjacent the first end portion of the base plate. The first sidewall defines a first plurality of ports. The first sidewall includes a linear portion. Ports of the first plurality of ports are positioned at the linear portion of the first sidewall. Each port of the first plurality of ports positioned at the linear portion of the first sidewall is angled towards the first end portion of the base plate. A second sidewall is mounted to the base plate and positioned adjacent the second end portion of the base plate. The second sidewall defines a second plurality of ports. The second sidewall includes a linear portion. Ports of the second plurality of ports are positioned at the linear portion of the second sidewall. Each port of the second plurality of ports positioned at the linear portion of the second sidewall is angled towards the second end portion of the base plate.

In a second exemplary embodiment, a range appliance is provided. The range appliance includes a cabinet and an elongated burner positioned on the cabinet at a top portion of the cabinet. The elongated burner defines a lateral direction and a transverse direction that are perpendicular to each other. The elongated burner includes a base plate. The base plate extends between a first end portion and a second end portion along the transverse direction. A first sidewall is mounted to the base plate and is positioned adjacent the first end portion of the base plate. The first sidewall defines a first plurality of ports. The first sidewall includes a linear portion. Ports of the first plurality of ports are positioned at the linear portion of the first sidewall. Each port of the first plurality of ports positioned at the linear portion of the first sidewall is angled between the lateral direction and the transverse direction. A second sidewall is mounted to the base plate and positioned adjacent the second end portion of the base plate. The second sidewall defines a second plurality of ports. The second sidewall includes a linear portion. Ports of the second plurality of ports are positioned at the linear portion of the second sidewall. Each port of the second plurality of ports positioned at the linear portion of the second sidewall is angled between the lateral direction and the transverse direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
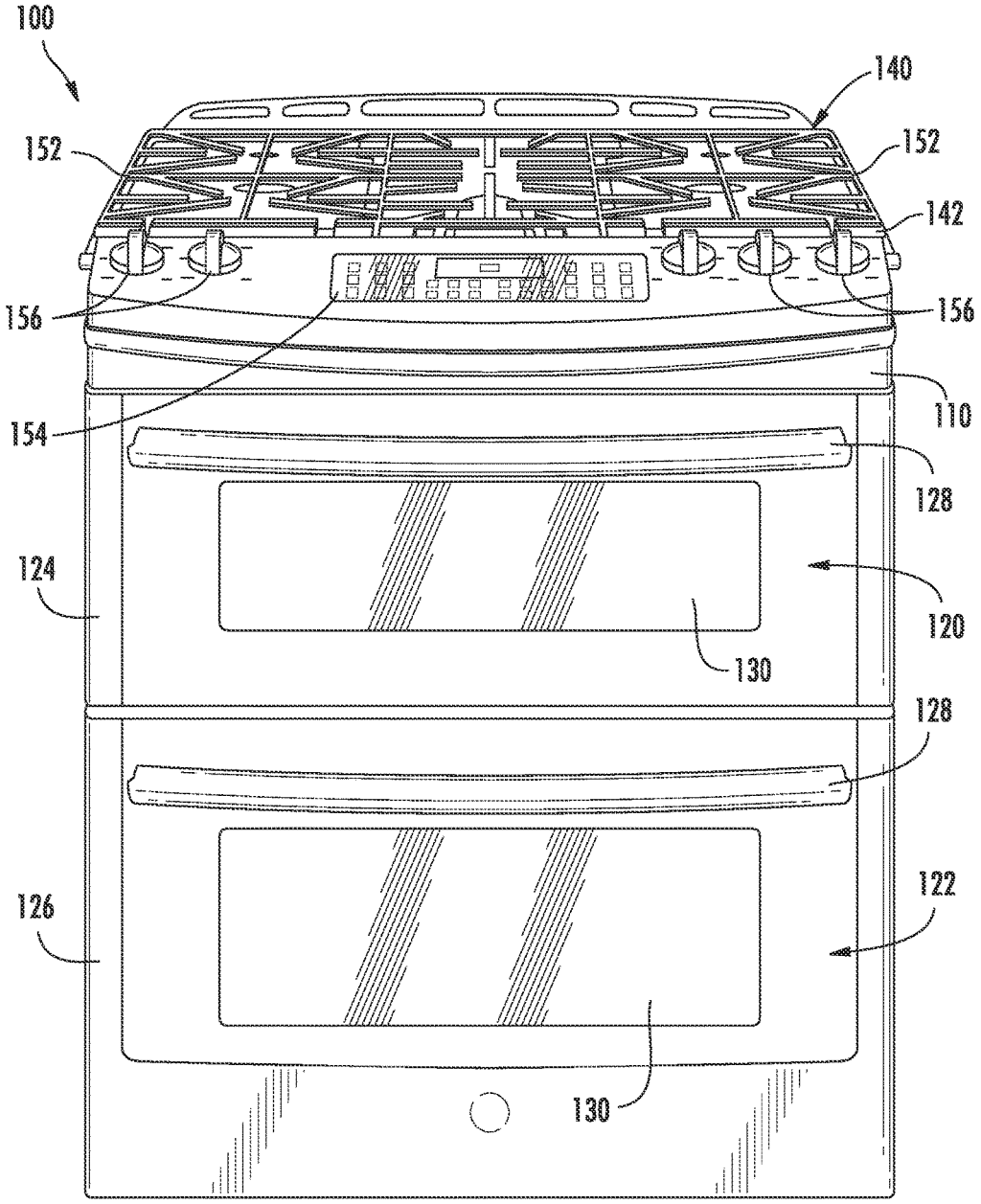
FIG. 1 provides a front, perspective view of a range appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
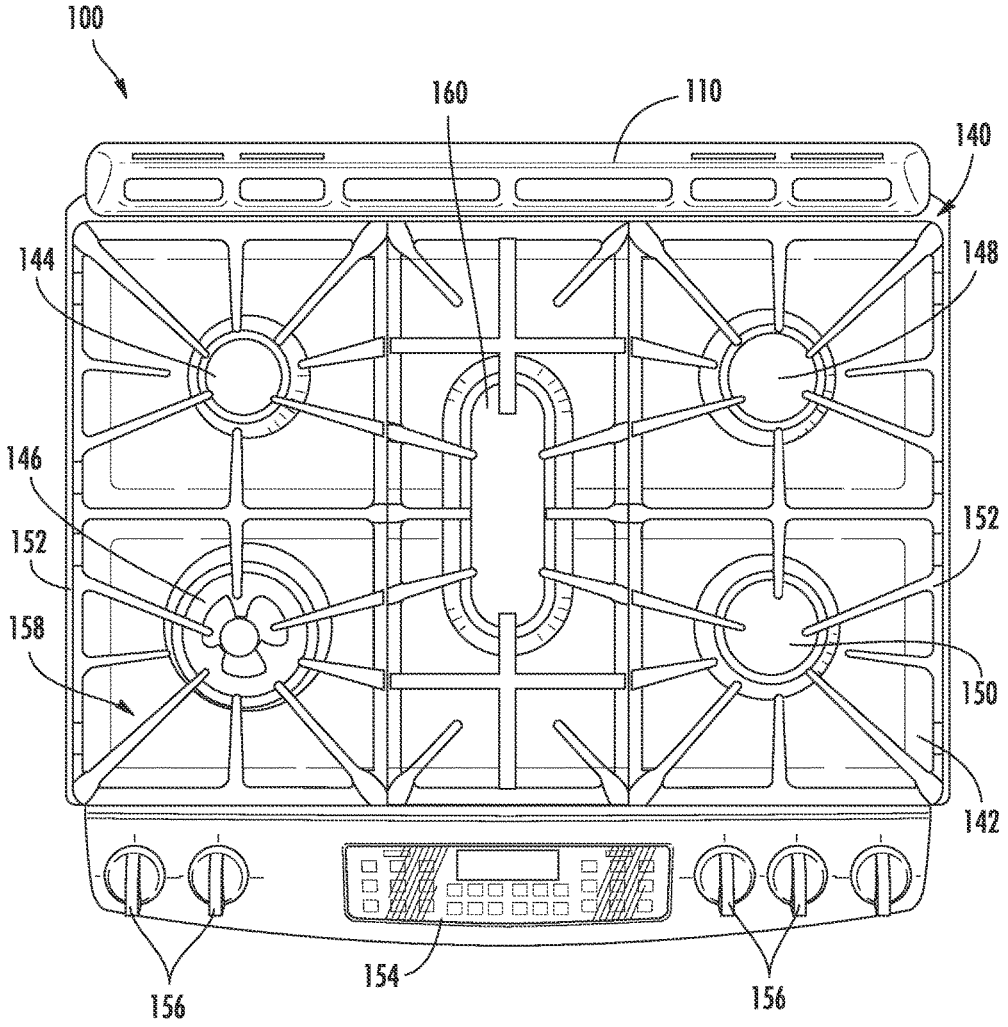
FIG. 2 provides a top, plan view of the exemplary range appliance of FIG. 1 and a burner assembly of the exemplary range appliance.

FIG. 1 provides a front, perspective view of a range appliance 100 as may be employed with the present subject matter. FIG. 2 provides a top, plan view of range appliance 100. Range appliance 100 includes an insulated cabinet 110. Cabinet 110 defines an upper cooking chamber 120 and a lower cooking chamber 122. Thus, range appliance 100 is generally referred to as a double oven range appliance. As will be understood by those skilled in the art, range appliance 100 is provided by way of example only, and the present subject matter may be used in any suitable range appliance, e.g., a single oven range appliance. Thus, the exemplary embodiment shown in FIG. 1 is not intended to limit the present subject matter to any particular cooking chamber configuration or arrangement.

Upper and lower cooking chambers 120 and 122 are configured for the receipt of one or more food items to be cooked. Range appliance 100 includes an upper door 124 and a lower door 126 rotatably attached to cabinet 110 in order to permit selective access to upper cooking chamber 120 and lower cooking chamber 122, respectively. Handles 128 are mounted to upper and lower doors 124 and 126 to assist a user with opening and closing doors 124 and 126 in order to access cooking chambers 120 and 122. As an example, a user can pull on handle 128 mounted to upper door 124 to open or close upper door 124 and access upper cooking chamber 120. Glass window panes 130 provide for viewing the contents of upper and lower cooking chambers 120 and 122 when doors 124 and 126 are closed and also assist with insulating upper and lower cooking chambers 120 and 122. Heating elements (not shown), such as electric resistance heating elements, gas burners, microwave heating elements, halogen heating elements, or suitable combinations thereof, are positioned within upper cooking chamber 120 and lower cooking chamber 122 for heating upper cooking chamber 120 and lower cooking chamber 122.

Range appliance 100 also includes a cooktop 140. Cooktop 140 is positioned at or adjacent a top portion of cabinet 110. Thus, cooktop 140 is positioned above upper and lower cooking chambers 120 and 122. Cooktop 140 includes a top panel 142. By way of example, top panel 142 may be constructed of glass, ceramics, enameled steel, and combinations thereof.

For range appliance 100, a utensil holding food and/or cooking liquids (e.g., oil, water, etc.) may be placed onto grates 152 at a location of any of burner assemblies 144, 146, 148, 150. Burner assemblies 144, 146, 148, 150 provide thermal energy to cooking utensils on grates 152. As shown in FIG. 1, burners assemblies 144, 146, 148, 150 can be configured in various sizes so as to provide e.g., for the receipt of cooking utensils (i.e., pots, pans, etc.) of various sizes and configurations and to provide different heat inputs for such cooking utensils. Grates 152 are supported on a top surface 158 of top panel 142. Range appliance 100 also includes a griddle burner 160 positioned at a middle portion of top panel 142, as may be seen in FIG. 2. A griddle may be positioned on grates 152 and heated with griddle burner 160.

A user interface panel 154 is located within convenient reach of a user of the range appliance 100. For this exemplary embodiment, user interface panel 154 includes knobs 156 that are each associated with one of burner assemblies 144, 146, 148, 150 and griddle burner 160. Knobs 156 allow the user to activate each burner assembly and determine the amount of heat input provided by each burner assembly 144, 146, 148, 150 and griddle burner 160 to a cooking utensil located thereon. User interface panel 154 may also be provided with one or more graphical display devices that deliver certain information to the user such as e.g., whether a particular burner assembly is activated and/or the level at which the burner assembly is set.

Although shown with knobs 156, it should be understood that knobs 156 and the configuration of range appliance 100 shown in FIG. 1 is provided by way of example only. More specifically, user interface panel 154 may include various input components, such as one or more of a variety of touch-type controls, electrical, mechanical or electro-mechanical input devices including rotary dials, push buttons, and touch pads. The user interface panel 154 may include other display components, such as a digital or analog display device designed to provide operational feedback to a user.

Figure 3:
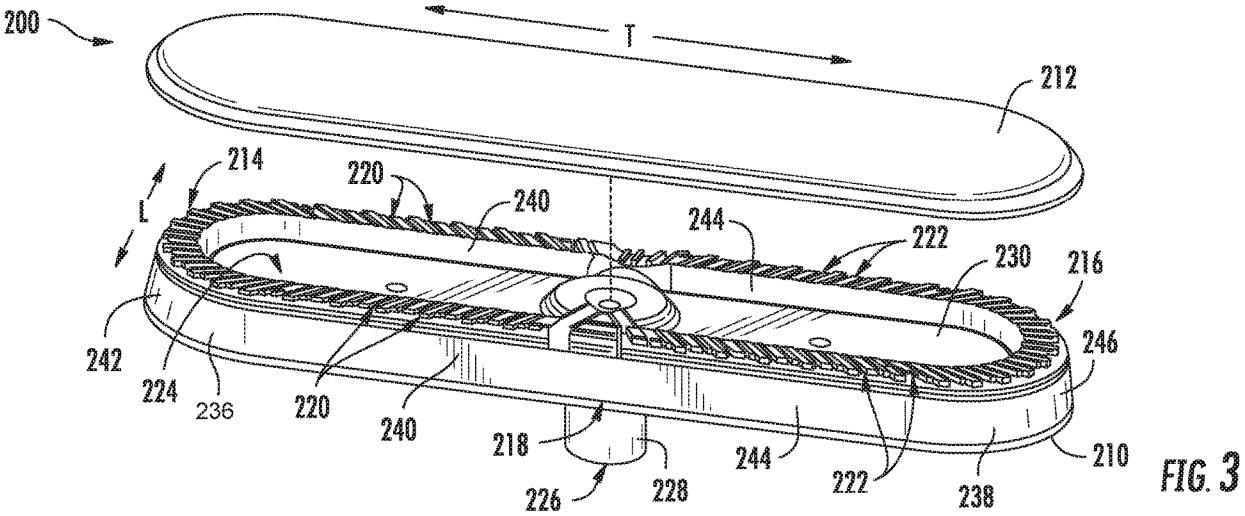
FIG. 3 provides an exploded view of an elongated burner assembly according to an exemplary embodiment of the present subject matter.
Figure 4:
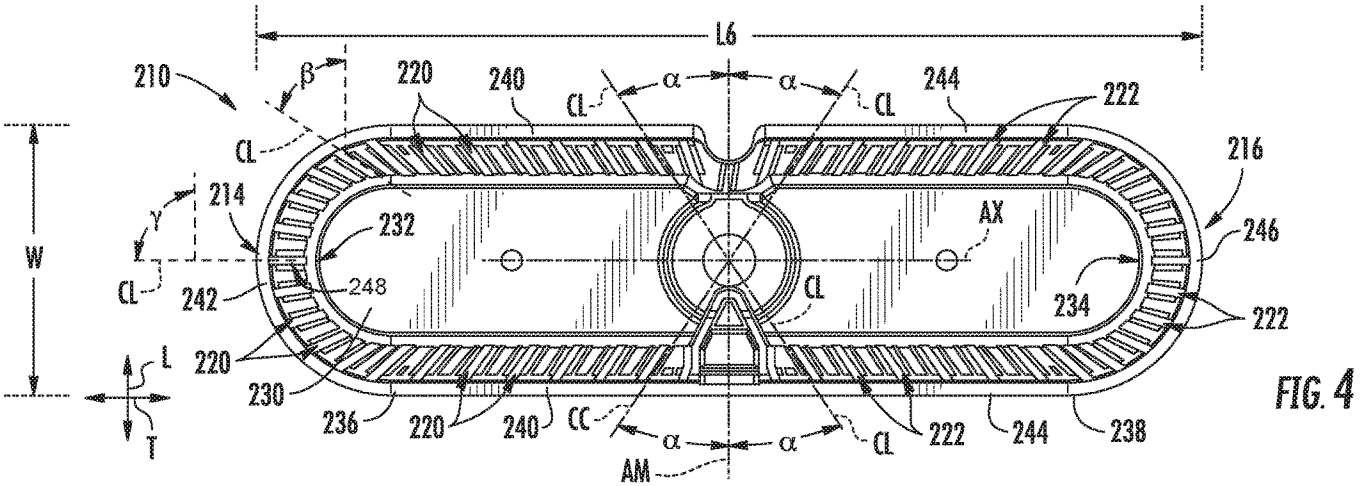
FIG. 4 provides a top, plan view of a burner base of the exemplary elongated burner assembly of FIG. 3.

FIG. 3 provides an exploded view of an elongated burner assembly 200 according to an exemplary embodiment of the present subject matter. FIG. 4 provides a top, plan view of a burner base 210 of elongated burner assembly 200. Burner assembly 200 may be used in any suitable appliance. For example, burner assembly 200 may be used in range appliance 100 (FIG. 2) as griddle burner 160. Burner assembly 200 includes features for assisting with heating large cookware, such as griddles or fish poachers. During operation of burner assembly 200, a user may heat a griddle or fish poacher with burner assembly 200 to assist the user with heating large cookware uniformly and/or evenly. Burner assembly 200 is discussed in greater detail below.

As may be seen in FIG. 3, burner assembly 200 includes a burner base 210 and a cover plate 212. Burner base 210 extends, e.g., along a transverse direction T, between a first end portion 214 and a second end portion 216. Thus, first and second end portions 214, 216 of burner base 210 are spaced apart from each other, e.g., along the transverse direction T. Burner base 210 also defines a first plurality of ports 220 and a second plurality of ports 222. First plurality of ports 220 is positioned at or adjacent first end portion 214 of burner base 210. Conversely, second plurality of ports 222 is positioned at or adjacent second end portion 216 of burner base 210. First and second pluralities of ports 220, 222 may be distributed or dispersed in a U pattern or shape, e.g., in plane that is perpendicular to a vertical direction, at first and second end portions 214, 216 of burner base 210, respectively.

Cover plate 212 may be positioned on or mounted to burner base 210. In particular, cover plate 212 may be positioned over first and second pluralities of ports 220, 222 on burner base 210. When cover plate 212 is positioned on burner base 210, cover plate 212 and burner base 210 define a fuel chamber 224 therebetween. Fuel chamber 224 is positioned and disposed for receiving gaseous fuel and is also configured for directing gaseous fuel to first and second pluralities of ports 220, 222.

Burner assembly 200 also includes a fuel inlet 226. As an example, burner base 210 may define fuel inlet 226. Gaseous fuel, such as natural gas or propane, may flow into fuel chamber 224 via or through fuel inlet 226. Thus, fuel chamber 224 is positioned and disposed for receiving the gaseous fuel from fuel inlet 226. As may be see in FIGS. 3 and 4, fuel inlet 226 may be only a single passage or conduit.

Gaseous fuel from fuel inlet 226 may flow through fuel chamber 224 to first and second pluralities of ports 220, 222. Thus, first and second pluralities of ports 220, 222 are in fluid communication with fuel inlet 226 via fuel chamber 224, e.g., due to fuel chamber 224 extending between first and second pluralities of ports 220, 222 within burner base 210. At first and second pluralities of ports 220, 222, the gaseous fuel may be combusted in order to heat cookware and food items therein.

As may be seen in FIG. 3, fuel inlet 226 includes a Venturi mixing tube 228. Venturi mixing tube 228 assists with mixing gaseous fuel flowing into burner assembly 200, e.g., with air, in order to assist combustion of the gaseous fuel at first and second pluralities of ports 220, 222. Venturi mixing tube 228 may be mounted to burner base 210 such that Venturi mixing tube 228 extends from burner base 210, e.g., downwardly along a vertical direction.

Turning now to FIG. 4, burner base 210 includes a base plate 230, a first sidewall 236 and a second sidewall 238. Burner base 210 also defines a major axis AX and a minor axis AM that are perpendicular to each other. Burner base 210 may be, e.g., substantially, symmetrical about the minor axis AM. Base plate 230 extends between a first end portion 232 and a second end portion 234, e,g., along the major axis AX and/or the transverse direction T. Base plate 230 defines a length L6 along the major axis AX and a width W along the minor axis AM (e.g., or along a lateral direction L that is perpendicular to the traverse direction T). The length L6 of base plate 230 may be any suitable length, and the width W of base plate 230 may be any suitable width. In certain exemplary embodiments, the length L6 of base plate 230 may be greater than the width W of base plate 230. As an example, the length L6 of base plate 230 may be at least two time greater than the width W of base plate 230.

First sidewall 236 is mounted to base plate 230 and is positioned adjacent or at first end portion 232 of base plate 230. First sidewall 236 defines first plurality of ports 220. In particular, first sidewall 236 includes linear portions 240 and an arcuate portion 242. Ports of first plurality of ports 220 are positioned on or at linear portions 240 and arcuate portion 242 of first sidewall 236. Thus, certain ports of the first plurality of ports 220 are positioned at or on linear portions 240 of first sidewall 236, and certain ports of first plurality of ports 220 are also positioned at or on arcuate portion 242 of first sidewall 236.

As may be seen in FIG. 4, each port of first plurality of ports 220 that is positioned at or on linear portions 240 of first sidewall 236 is angled towards first end portion 232 of base plate 230. Thus, when fuel is exiting ports of the first plurality of ports 220 that are positioned at or on linear portions 240 of first sidewall 236, such fuel has a vector component along the major axis AX and/or the transverse direction T towards the first end portion 232 of base plate 230.

As may be seen in FIG. 4, each port of first plurality of ports 220 that is positioned at linear portions 240 of first sidewall 236 defines a center line CL. The center line CL of each port of first plurality of ports 220 that is positioned at linear portions 240 of first sidewall 236 defines an angle $\alpha$ with the minor axis AM. The angle $\alpha$ may be any suitable angle. For example, the angle $\alpha$ may be greater than twenty degrees and less than sixty degrees. As another example, the angle $\alpha$ may be about (e.g., within about ten degrees of) fifty-five degrees. Such angling of the ports of first plurality of ports 220 that are positioned at linear portions 240 of first sidewall 236 may assist with biasing heating of cookware with burner assembly 200 towards first end portion 214 of burner base 210. Thus, the cookware may be heated more evenly with burner assembly 200.

Arcuate portion 242 of first sidewall 236 extends from each linear portion 240 of first sidewall 236 towards first end portion 232 of base plate 230. In particular, arcuate portion 242 of first sidewall 236 may extend between and connect linear portions 240 of first sidewall 236 at first end portion 232 of base plate 230. As discussed above, certain ports of first plurality of ports 220 are positioned at or on arcuate portion 242 of first sidewall 236. Each port of first plurality of ports 220 positioned at or on arcuate portion 242 of first sidewall 236 also define a center line CL. The center line CL of each port of first plurality of ports 220 that is positioned at arcuate portion 242 of first sidewall 236 defines an angle $\beta$ with the minor axis AM. In FIG. 4, angle $\beta$ is shown defined between a line that is parallel to the minor axis AM and the center line CL of a port of first plurality of ports 220 positioned at arcuate portion 242 of first sidewall 236 for convenience. The angle $\beta$ may be any suitable angle. As example, the angle $\beta$ may be greater than the angle $\alpha$. In addition, the angle $\beta$ may increase from linear portions 240 of first sidewall 236 to first end portion 232 of base plate 230, as shown in FIG. 4. In particular, the angle $\beta$ may approach ninety degrees for the ports of first plurality of ports 220 that are positioned on arcuate portion 242 of first sidewall 236 at first end portion 232 of base plate 230. For example, an end port 248 of first plurality of ports 220 is positioned at first end portion 232 of base plate 230. The center line CL of end port 248 defines an angle $\gamma$ with the minor axis AM. In FIG. 4, angle $\gamma$ is shown defined between a line that is parallel to the minor axis AM and the center line CL of end port 248 for convenience. The angle $\gamma$ may be any suitable angle. For example, the angle $\gamma$ may be greater than eighty-five degrees. In particular, the angle $\gamma$ may be about (e.g., with five degrees of) ninety degrees. Such angling of the ports of first plurality of ports 220 that are positioned at arcuate portion 242 of first sidewall 236 may assist with biasing heating of cookware with burner assembly 200 towards first end portion 214 of burner base 210. Thus, the cookware may be heated more evenly with burner assembly 200. In addition, such angling of the ports of first plurality of ports 220 that are positioned at arcuate portion 242 of first sidewall 236 may assist with providing a pleasant appearance and distribution of flames at first plurality of ports 220.

First sidewall 236 and second sidewall 238 may be symmetrical about the minor axis AM. Thus, second plurality of ports 222 may be distributed and angled on second sidewall 238 in a similar or same manner as first plurality of ports 220 on first sidewall 236 described above. As an example, second sidewall 238 is mounted to base plate 230 and is positioned at or adjacent second end portion 234 of base plate 230. Second sidewall 238 defines second plurality of ports 222. Second sidewall 238 includes linear portions 244 and an arcuate portion 246. Ports of second plurality of ports 222 are positioned on or at linear portions 244 and arcuate portion 246 of second side wall 238. Thus, certain ports of the second plurality of ports 222 are positioned at or on linear portions 244 of second sidewall 238, and certain ports of second plurality of ports 222 are also positioned at or on arcuate portion 246 of second sidewall 238. Each port of second plurality of ports 222 that is positioned at or on linear portions 244 of second sidewall 238 is angled towards second end portion 234 of base plate 230. Such angling of the ports of second plurality of ports 222 that are positioned at linear portions 244 of second sidewall 238 may assist with biasing heating of cookware with burner assembly 200 towards second end portion 216 of burner base 210.

Burner base 210 may be constructed of or with any suitable material. For example, base plate 230, first sidewall 236 and second sidewall 238 may be formed of or with a single continuous piece of, e.g., cast, aluminum, steel or aluminum alloy. It should be understood that, in alternative exemplary embodiments, base plate 230, first sidewall 236 and second sidewall 238 may be formed from separate or discrete pieces of material that are mounted or secured to each other. In addition, Venturi mixing tube 228 may be mounted to base plate 230 at middle portion 218 of burner base 210. Cover plate 212 may also be positioned over first and second sidewalls 236, 238. Thus, cover plate 212, base plate 230 and first and second sidewalls 236, 238 may cooperate to define fuel chamber 224.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An elongated burner assembly defining a major axis and a minor axis, the major axis being perpendicular to the minor axis, the elongated burner comprising:

a base plate extending linearly between a first end portion and a second end portion along the major axis, the base plate defining a length along the major axis and a width along the minor axis, the length of the base plate at least two times greater than the width of the base plate;

a first sidewall mounted to the base plate and positioned adjacent the first end portion of the base plate, the first sidewall defining a first plurality of ports, the first sidewall including two linear portions that are parallel and spaced along the minor axis, ports of the first plurality of ports positioned at the linear portions of the first sidewall, each port of the first plurality of ports positioned at the linear portions of the first sidewall angled towards the first end portion of the base plate; and a second sidewall mounted to the base plate and positioned adjacent the second end portion of the base plate, the second sidewall defining a second plurality of ports, the second sidewall including two linear portions that are parallel and spaced along the minor axis, ports of the second plurality of ports positioned at the linear portions of the second sidewall, each port of the second plurality of ports positioned at the linear portions of the second sidewall angled towards the second end portion of the base plate.

2. The elongated burner assembly of claim 1, wherein each port of the first plurality of ports positioned at the linear portions of the first sidewall defines a center line, the center line of each port of the first plurality of ports positioned at the linear portions of the first sidewall defining an angle $\alpha$ with the minor axis, the angle $\alpha$ being greater than twenty degrees and less than sixty degrees.

3. The elongated burner assembly of claim 2, wherein the angle $\alpha$ is about fifty-five degrees.

4. The elongated burner assembly of claim 1, wherein the first sidewall also includes an arcuate portion, the arcuate portion of the first sidewall extending between the linear portions of the first sidewall at the first end portion of the base plate, ports of the first plurality of ports positioned at the arcuate portion of the first sidewall, each port of the first plurality of ports positioned at the arcuate portion of the first sidewall defining a center line, the center line of each port of the first plurality of ports positioned at the arcuate portion of the first sidewall defining an angle $\beta$ with the minor axis, the angle $\beta$ increasing from the linear portions of the first sidewall and the first end portion of the base plate.

5. The elongated burner assembly of claim 1, wherein an end port of the first plurality of ports is positioned at the first end portion of the base plate, the end port of the first plurality of ports defining a center line, the center line of the end port of the first plurality of ports defining an angle $\gamma$ with the minor axis, the angle $\gamma$ being greater than eighty-five degrees.

6. The elongated burner assembly of claim 1, wherein first and second sidewalls are symmetrical about the minor axis.

7. The elongated burner assembly of claim 1, further comprising a Venturi mixing tube mounted to the base plate at a middle portion of the base plate.

8. The elongated burner assembly of claim 7, further comprising a cover plate positioned over the first and second sidewalk, the cover plate, the base plate and the first and second sidewalls defining a fuel chamber, the Venturi mixing tube configured for directing fuel into the fuel chamber, the first and second pluralities of ports configured for directing fuel out of the fuel chamber.

9. The elongated burner assembly of claim 1, wherein the base plate, the first sidewall and the second sidewall are formed with a single continuous piece of aluminum.

10. A range appliance comprising;

a cabinet;

an elongated burner positioned on the cabinet at a top portion of the cabinet, the elongated burner defining a lateral direction and a transverse direction that are perpendicular to each other, the elongated burner comprising a base plate extending linearly between a first end portion and a second end portion along the transverse direction, the base plate defining a length along the transverse direction and a width along the lateral direction, the length of the base plate at least twice the width of the base plate;

a first sidewall mounted to the base plate and positioned adjacent the first end portion of the base plate, the first sidewall defining a first plurality of ports, the first sidewall including two linear portions that are parallel and spaced along the lateral direction, ports of the first plurality of ports positioned at the linear portions of the first sidewall, each port of the first plurality of ports positioned at the linear portions of the first sidewall angled between the lateral direction and the transverse direction; and a second sidewall mounted to the base plate and positioned adjacent the second end portion of the base plate, the second sidewall defining a second plurality of ports, the second sidewall including two linear portions that are parallel and spaced along the lateral direction, ports of the second plurality of ports positioned at the linear portions of the second sidewall, each port of the second plurality of ports positioned at the linear portions of the second sidewall angled between the lateral direction and the transverse direction.

11. The range appliance of claim 10, wherein each port of the first plurality of ports positioned at the linear portions of the first sidewall angled such that each port of the first plurality of ports positioned at the linear portions of the first sidewall is not parallel to either the lateral direction or the transverse direction.

12. The range appliance of claim 10, wherein each port of the first plurality of ports positioned at the linear portions of the first sidewall defines a center line, the center line of each port of the first plurality of ports positioned at the linear portions of the first sidewall defining an angle $\alpha$ with the lateral direction, the angle $\alpha$ being greater than twenty degrees and less than sixty degrees.

13. The range appliance of claim 12, wherein the angle $\alpha$ is about fifty-five degrees.

14. The range appliance of claim 12, wherein the first sidewall also includes an arcuate portion, the arcuate portion of the first sidewall extending between the linear portions of the first sidewall at the first end portion of the base plate, ports of the first plurality of ports positioned at the arcuate portion of the first sidewall, each port of the first plurality of ports positioned at the arcuate portion of the first sidewall defining a center line, the center line of each port of the first plurality of ports positioned at the arcuate portion of the first sidewall defining an angle $\beta$ with the lateral direction, the angle $\beta$ increasing from the linear portions of the first sidewall and the first end portion of the base plate.

15. The range appliance of claim 10, wherein an end port of the first plurality of ports is positioned at the first end portion of the base plate, the end port of the first plurality of ports defining a center line, the center line of the end port of the first plurality of ports defining an angle $\gamma$ with the lateral direction, the angle $\gamma$ being greater than eighty-five degrees.

16. The range appliance of claim 10, further comprising a Venturi mixing tube mounted to the base plate at a middle portion of the base plate.

17. The range appliance of claim 16, further comprising a cover plate positioned over the first and second sidewalls, the cover plate, the base plate and the first and second sidewalls defining a fuel chamber, the Venturi mixing tube configured for directing fuel into the fuel chamber, the first and second pluralities of ports configured for directing fuel out of the fuel chamber.

* * * * *